US010910747B1

(12) United States Patent
He et al.

(10) Patent No.: US 10,910,747 B1
(45) Date of Patent: Feb. 2, 2021

(54) ENGAGEMENT STRUCTURE OF ETHERNET CONNECTOR FOR VEHICLE

(71) Applicant: AMPHENOL EAST ASIA ELECTRONIC TECHNOLOGY (SHEN ZHEN) CO., LTD., Shen Zhen (CN)

(72) Inventors: Dan Ren He, Shen Zhen (CN); Jian Qiang Shen, Shen Zhen (CN)

(73) Assignees: AMPHENOL EAST ASIA ELECTRONIC TECHNOLOGY, Shen Zhen (CN); (SHEN ZHEN) CO., LTD., Shen Zhen (CN)

( * ) Notice: Subject to any disclaimer, the term of this patent is extended or adjusted under 35 U.S.C. 154(b) by 0 days.

(21) Appl. No.: 16/726,585

(22) Filed: Dec. 24, 2019

(51) Int. Cl.

| | |
|---|---|
| ***H01R 12/75*** | (2011.01) |
| ***H01R 13/506*** | (2006.01) |
| ***H01R 13/52*** | (2006.01) |
| ***H01R 13/627*** | (2006.01) |

(52) U.S. Cl.
CPC ..... *H01R 12/75* (2013.01); *H01R 13/506* (2013.01); *H01R 13/5205* (2013.01); *H01R 13/5221* (2013.01); *H01R 13/6272* (2013.01)

(58) Field of Classification Search
CPC .. H01R 12/75; H01R 13/506; H01R 13/5205; H01R 13/5221; H01R 13/6272
USPC ..... 439/78
See application file for complete search history.

(56) References Cited

U.S. PATENT DOCUMENTS

| | | | | |
|---|---|---|---|---|
| 6,537,098 | B2 * | 3/2003 | Kashiyama | H01R 13/641 439/352 |
| 7,811,115 | B1 * | 10/2010 | Tyler | H01R 13/53 439/352 |
| 8,083,533 | B2 * | 12/2011 | De Chazal | H01R 13/7031 439/188 |
| 8,905,777 | B2 * | 12/2014 | Zhu | H01R 13/62 439/352 |

* cited by examiner

*Primary Examiner* — Hien D Vu
(74) *Attorney, Agent, or Firm* — Muncy, Geissler, Olds & Lowe, P.C.

(57) ABSTRACT

The prevent invention relates to connector fields, and more particularly, to an engagement structure of Ethernet connector for vehicle. The plug and the socket are combined and engaged; the plug shell mounted around an outer periphery of the male terminal assembly; the plug shell including a lock plate and a lock seat. When the plug is combined with the cable end socket, the plug shell is inserted into the cable end socket shell, with the circular male terminal combined with the circular female terminal. When the lock plate is pushed from the second end toward the first end of the rail, the ramp elastically crosses over the second end of the bolt member to be engaged between the ramp and the protrusion, and the hook member is engaged with the outer hook.

7 Claims, 9 Drawing Sheets

ENGAGEMENT STRUCTURE OF ETHERNET CONNECTOR FOR VEHICLE

BACKGROUND OF THE INVENTION

1. Field of the Invention

The present invention relates to connectors, and more particularly, to an engagement structure of Ethernet connector for vehicle.

2. Description of the Related Art

With the technical development of autopilot technique and IoT (Internet of Things) in the vehicle market, regarding the Ethernet connector applied for the internet transmission of vehicles, the current transmission rate, such as 100 Mbps or 1000 Mbps, is unable to fulfill user requirements, and an Ethernet connector having features of high speed transmission, water proof, stability, and operation intensity becomes an important subject in the field of signal transmission connectors for the internet of vehicles. Therein, the improvements of socket connection and the structural stability of the socket itself are desirable for related researches as well.

SUMMARY OF THE INVENTION

The present invention aims at resolving the existing technical disadvantages and providing an engagement structure of Ethernet connector for vehicle. With the structural improvements, issues of low transmission efficiency, insufficient engaging strength, insufficient interference proof, and less applicable scope are solved.

For achieving the aforementioned objectives, an engagement structure of Ethernet connector for vehicle is provided, comprising:

a plug and a socket; the plug and the socket being combined and engaged together;

the plug comprising a plug shell and a male terminal assembly; the socket combined with a cable to form a cable end socket; the cable end socket comprising a cable end socket shell and a female terminal assembly;

the plug shell being mounted around an outer periphery of the male terminal assembly; the plug shell comprising a lock plate and a lock seat;

the lock plate comprising a hook member, a ramp, and a protrusion; the hook member being disposed on a first end of the lock plate; the ramp and the protrusion being disposed on a top portion of the lock plate;

the lock seat being disposed on a top portion of the plug shell, and internally comprising a rail and a bolt member; the lock plate sliding in the rail; the bolt member being transversely disposed in the lock seat;

the cable end socket shell comprising an outer hook and an elastic plate;

the outer hook being disposed on an outer side of a top portion of the cable end socket shell;

the male terminal assembly comprising a circular male terminal;

the female terminal assembly comprising a circular female terminal;

when the plug is combined with the cable end socket, the plug shell is inserted into the cable end socket shell, with the circular male terminal combined with the circular female terminal; when the lock plate is at a second end of the rail, the ramp resists a second end of the bolt member; when the lock plate is pushed from the second end of the rail toward a first end of the rail, the ramp elastically deforms to cross over the second end of the bolt member, such that the bolt member is engaged between the ramp and the protrusion, and the hook member is engaged with the outer hook of the cable end socket shell.

Preferably, in the Ethernet connector for vehicle in accordance with the embodiment of the present invention, the plug and the cable end socket comprise a mask, respectively. The mask of the cable end socket comprises an elastic plate. The elastic plate is disposed at a first end of the mask of the cable end socket. When the plug is combined with the cable end socket, the elastic plate contacts the mask of the plug.

Preferably, in the Ethernet connector for vehicle in accordance with the embodiment of the present invention, the socket is combined with a PCB to form a board end socket; the plug being combined and engaged with the board end socket; the board end socket comprising a board end socket shell and a female terminal assembly;

the board end socket shell comprising an outer hook;

the outer hook is disposed on an outer side of the top portion of the board end socket shell;

the female terminal assembly comprising a circular female terminal;

when the plug is combined with the board end socket, the plug shell is inserted into the board end socket shell, and the circular male terminal is combined with the circular female terminal; when the lock plate is at the second end of the rail, the ramp resists the second end of the bolt member; when the lock plate is pushed from the second end of the rail toward the first end of the rail, the ramp elastically deforms to cross over the second end of the bolt member, such that the bolt member is engaged between the ramp and the protrusion, and the hook member is engaged with the outer hook.

Preferably, in the Ethernet connector for vehicle in accordance with the embodiment of the present invention, the plug and the cable end socket comprise a mask, respectively, which is integrally formed through a die-casting manner to form a mask providing a whole-masking function, so as to wrap the male terminal assembly or the female terminal assembly. The mask of the cable end socket comprises an elastic plate. The elastic plate is disposed at a first end of the mask of the cable end socket. When the plug is combined with the cable end socket, the elastic plate contacts the mask of the plug.

Preferably, in the Ethernet connector for vehicle in accordance with the embodiment of the present invention, the plug comprises a cable seal member, a plug protection member, and an insertion seal member;

the cable seal member being mounted around an outer periphery of the male terminal assembly; a first end of the cable seal member resisting against a second end of the plug shell, with a second end of the cable seal member resisting against a second end of the plug protection member;

the plug protection member wrapping the plug shell;

the insertion seal member being disposed on an inner side of an end of the plug shell; when the plug is combined with the cable end socket, the insertion seal member is positioned between the plug shell and the cable end socket shell.

Preferably, in the Ethernet connector for vehicle in accordance with the embodiment of the present invention, the cable end socket comprises a cable seal member and a protection member; the cable seal member being mounted around an outer periphery of the female terminal assembly; a first end of the cable seal member resisting against a second end of the plug shell, and the second end of the cable seal member resisting against a second end of the protection member;

the protection member wrapping the cable end socket shell.

Preferably, in the Ethernet connector for vehicle in accordance with the embodiment of the present invention, the plug and an insertion port of the socket, besides of being in a 1×1 mode, are also allowed to be in a multiple ports mode, such as 1×2, 1×3, 1×4, 1×5, 2×2, 2×3 or 2×4 modes.

With the aforementioned configuration, the present invention achieves following advantages.

Compared with prior arts, the present invention, with an optimization of the connector structure, resolves the issue of insufficient locking force between the socket and the plug through an engagement structure, which is achieved by the lock plate and the lock seat disposed on the plug shell. When the plug is combined with the socket, the lock plate engages the bolt member through the ramp and the protrusion at the second end thereof, with the hook member of the first end engaged the outer hook, so as to achieve a double engagement function. On the basis of the engagement structure, the water proof sealing function is improved. While the plug and the cable/board end socket comprise the cable seal member and the protection member, a multiple protection mechanism is provided. Regarding a portion having a weaker sealing effect between the plug and the cable/board end socket, the insertion seal member is specifically provided. For fulfilling the cable-to-cable and cable-to-board application modes in different application sites, the insertion port of the plug is allowed to be extended to a multiple ports mode from 1×1 to, for example, 1×2, 1×3, 1×4, 1×5, 2×2, 2×3 or 2×4 modes.

DETAILED DESCRIPTION OF THE INVENTION

Figure 1:
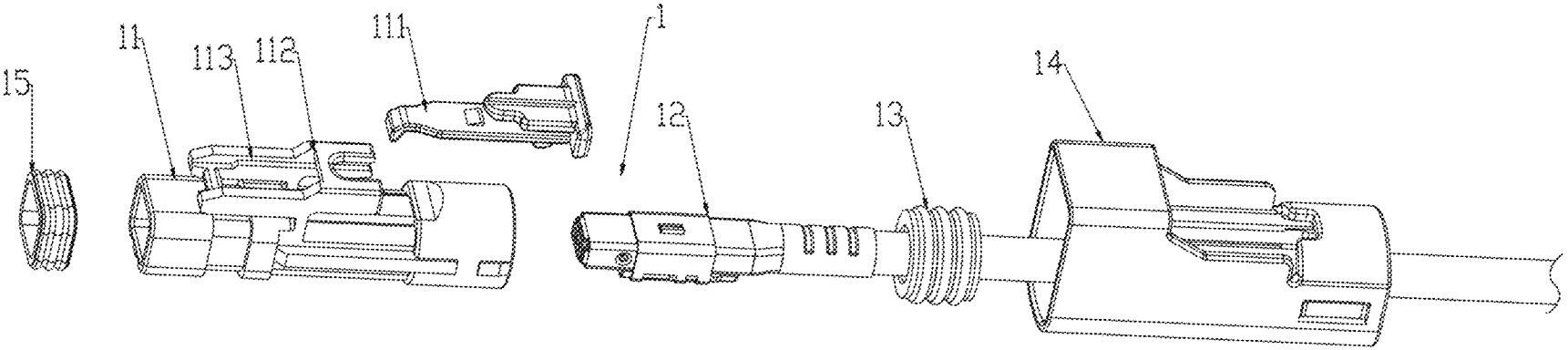
FIG. 1 is an exploded view of the Ethernet connector for vehicle, illustrating an engagement structure of the plug in accordance with an embodiment of the present invention.
Figure 2:
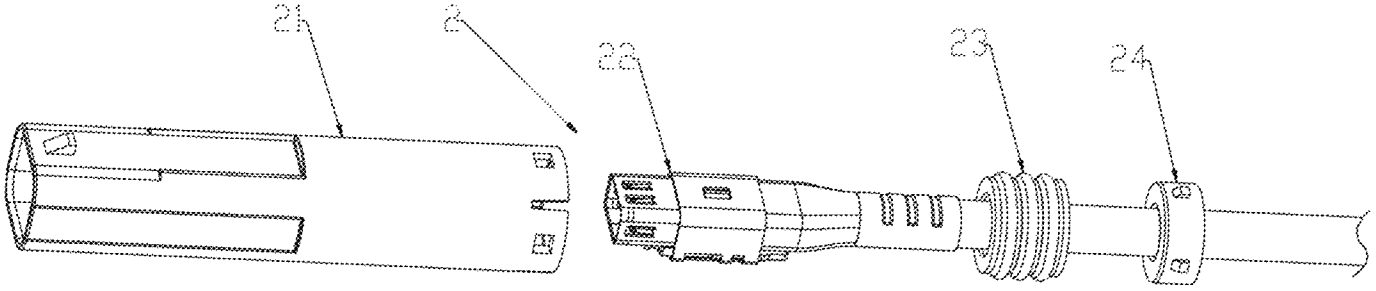
FIG. 2 is an exploded view of the Ethernet connector for vehicle, illustrating the engagement structure of the able end socket in accordance with an embodiment of the present invention.
Figure 3:
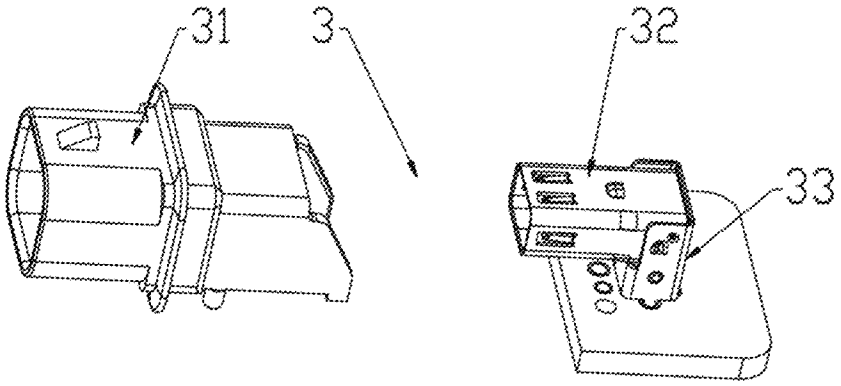
FIG. 3 is an exploded view of the Ethernet connector for vehicle, illustrating the engagement structure of the board end socket in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

FIG. 1 to FIG. 9 are applied for providing a detailed illustration of the embodiments of the present invention, instead of imposing any limitations upon the features of the present invention.

Embodiment 1

An engagement structure of Ethernet connector for vehicle is provided, as shown by FIG. 1, FIG. 2, FIG. 4, and FIG. 6, comprising a plug 1 and a cable end socket 2. The plug 1 and the cable end socket 2 are combined and engaged together. The plug 1 comprises a plug shell 11 and a male terminal assembly 12. The cable end socket 2 comprises a cable end socket shell 21 and a female terminal assembly 22.

The plug shell 11 is mounted around an outer periphery of the male terminal assembly 12. The plug shell 11 comprises a lock plate 111 and a lock seat 112.

The lock seat 111 comprises a hook member 114, a ramp 115, and a protrusion 117. The hook member 114 is disposed on a first end of the lock plate 111; the ramp 115 and the protrusion 117 are disposed on a top portion of the lock plate 111.

The lock seat 112 is disposed on a top portion of the plug shell 11, and internally comprises a rail 113 and a bolt member 116. The lock plate 111 is able to slide in the rail 113; the bolt member 116 is transversely disposed in the lock seat 112. The cable end socket shell 21 comprises an outer hook 211 and an elastic plate 212.

The outer hook 211 is disposed on an outer side of a top portion of the cable end socket shell 21.

The male terminal assembly 12 comprises a circular male terminal 121.

The female terminal assembly 22 comprises a circular female terminal 221.

Figure 4:
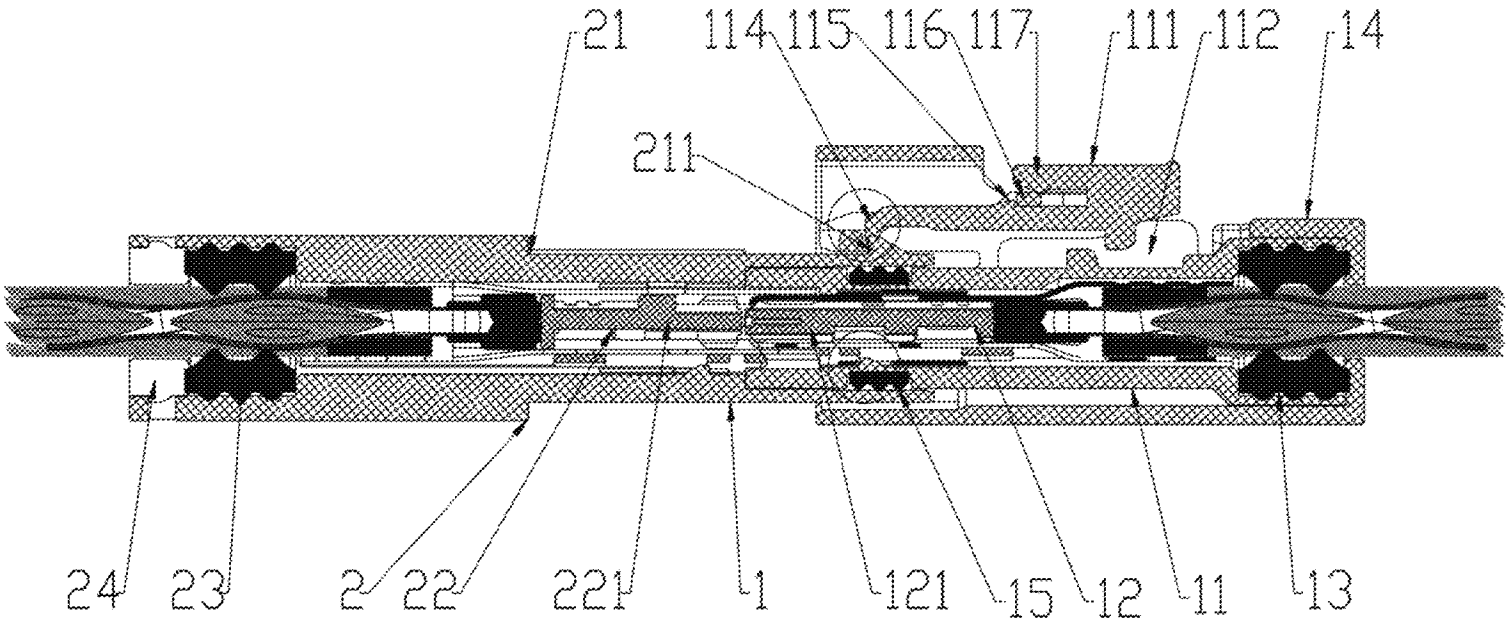
FIG. 4 is a sectional view illustrating the engagement structure of the plug and the cable end socket.
Figure 5:
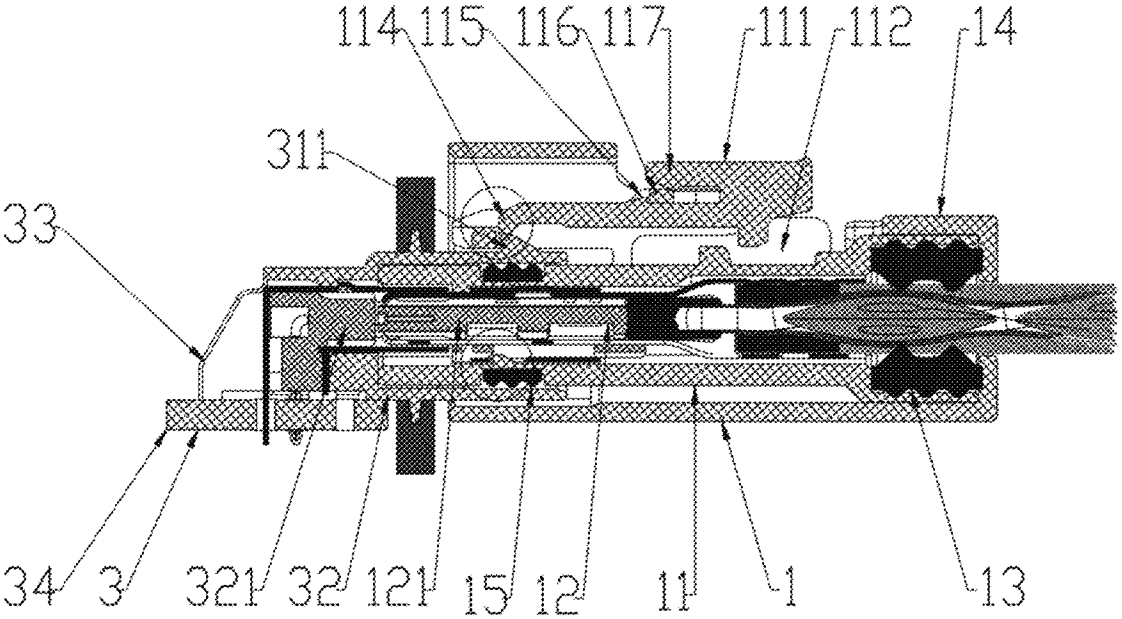
FIG. 5 is a sectional view illustrating the engagement structure of plug and the board end socket.

When the plug 1 is combined with the cable end socket 2, as shown by FIG. 4, the plug shell 11 is inserted into the cable end socket shell 21, with the circular male terminal 121 combined with the circular female terminal 221; when the lock plate 111 is at a second end of the rail 113, the ramp 115 resists a second end of the bolt member 116; the lock plate 111 is pushed from the second end of the rail 113 toward a first end of the rail 113, and the ramp 115 elastically deforms to cross over the second end of the bolt member 116, such that the bolt member 116 is engaged between the ramp 115 and the protrusion 117, and the hook member 114 is engaged with the outer hook 211 of the cable end socket shell.

Figure 6:
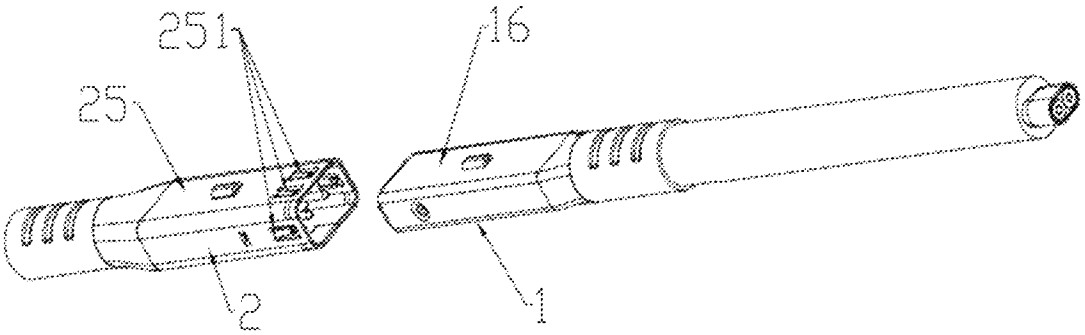
FIG. 6 is a schematic view illustrating the combination of the elastic plate (plug and the cable end socket).

Referring to FIG. 6, the plug 1 and the cable end socket 2 comprise a mask 16 and a mask 25, respectively. The mask 25 of the cable end socket 2 comprises an elastic plate 251. The elastic plate 251 is disposed at a first end of the mask 25 of the cable end socket 2. When the plug 1 is combined with the cable end socket 2, the elastic plate 251 contacts the mask 16 of the plug 1.

The plug 1 comprises a cable seal member 13, a plug protection member 14, and an insertion seal member 15.

The cable seal member 13 is mounted around an outer periphery of the male terminal assembly 12. A first end of the cable seal member 13 resists against a second end of the plug shell 11, with a second end of the cable seal member 13 resisting against a second end of the plug protection member 14.

The plug protection member 14 wraps the plug shell 11 therein.

The insertion seal member 15 is disposed on an inner side of an end of the plug shell 11. When the plug 1 is combined with the cable end socket 2, the insertion seal member 15 is positioned between the plug shell 11 and the cable end socket shell 21.

The cable end socket 2 comprises a cable seal member 23 and a protection member 24.

The cable seal member 23 is mounted around an outer periphery of the female terminal assembly 22. A first end of the cable seal member 23 resists against a second end of the plug shell 11, and the second end of the cable seal member 23 resisting against a second end of the protection member 24.

The protection member 24 wraps the cable end socket shell 21 therein.

Embodiment 2

On the basis of the embodiment 1, the Ethernet connector for vehicle, as shown by FIG. 1, FIG. 3, FIG. 5, and FIG. 7, comprises a board end socket 3, wherein the plug 1 is combined and engaged with the board end socket 3.

The board end socket 3 comprises a board end socket shell 31 and a female terminal assembly 32.

The board end socket shell 31 comprises an outer hook 311.

The outer hook 311 is disposed on an outer side of the top portion of the board end socket shell 31.

The female terminal assembly 32 comprises a circular female terminal 321.

When the plug 1 is combined with the board end socket 3, the plug shell 11 is inserted into the board end socket shell 31, and the circular male terminal 121 is combined with the circular female terminal 321. When the lock plate 111 is at the second end of the rail 113, the ramp 115 resists the second end of the bolt member 116; when the lock plate 111 is pushed from the second end of the rail 113 toward the first end of the rail 113, the ramp 115 elastically deforms to cross over the second end of the bolt member 116, such that the bolt member 116 is engaged between the ramp 115 and the protrusion 117, and the hook member 114 is engaged with the outer hook 311.

Figure 7:
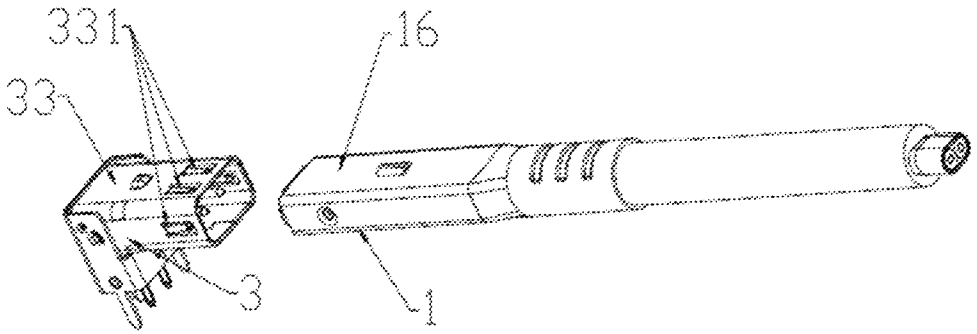
FIG. 7 is a schematic view illustrating the combination of the elastic plate (plug and the board end socket).

Referring to FIG. 7, the plug 1 and the board end socket 3 comprise a mask 16 and a mask 33, respectively. The elastic plate 331 is disposed at a first end of the mask 33 of the board end socket 3. When the plug 1 is combined with the board end socket 3, the elastic plate 331 of the board end socket 3 contacts the mask 16 of the plug 1.

Embodiment 3

Figure 8:
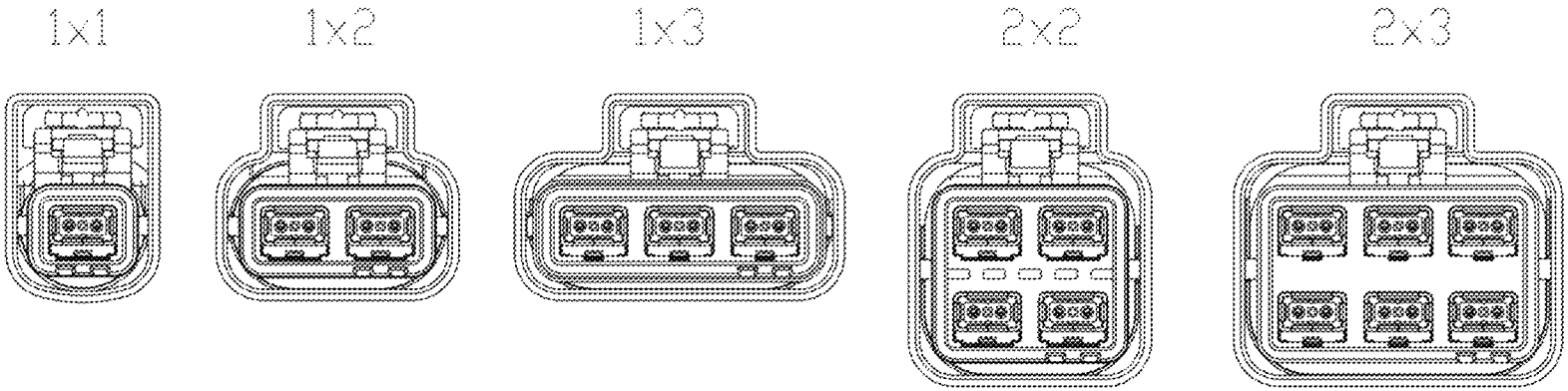
FIG. 8 is a schematic view illustrating the extension of the plug ports.
Figure 9:
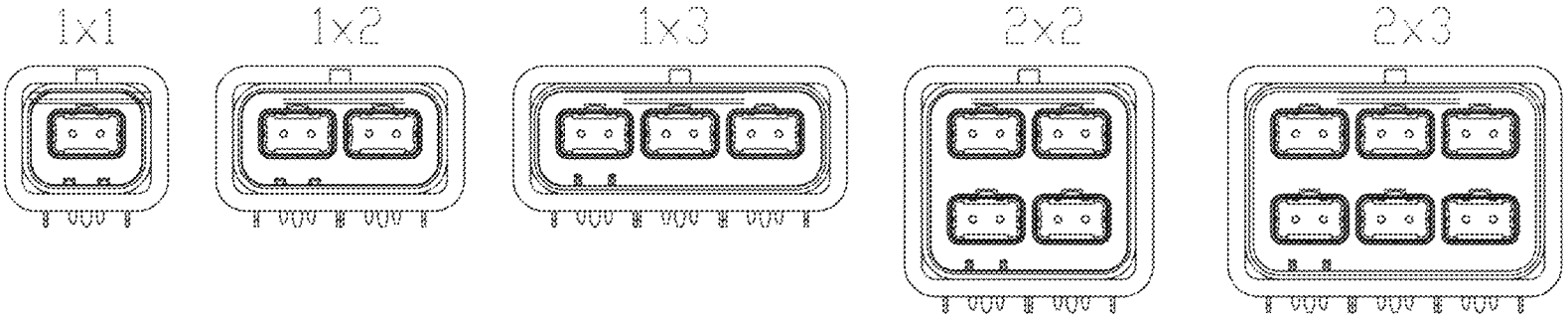
FIG. 9 is a schematic view illustrating the extension of the cable/board end socket ports.

On the basis of the previous embodiments, in the Ethernet connector for vehicle in accordance with the embodiment of the present invention, as shown by FIG. 8, and FIG. 9, the plug 1 and the insertion port of the cable end socket 2 or the board end socket 3, besides of being in a 1×1 mode, are also to be allowed to be in a multiple ports mode, such as 1×2, 1×3, 1×4, 1×5, 2×2, 2×3 or 2×4 modes.

Based on technical common sense, this technical solution can be implemented by other embodiments not departing from its spiritual essence or necessary features. Therefore, the embodiments disclosed above are merely examples for all aspects, and are not the only possibility of the present invention. All variations within the scope of or equivalent to this invention are included in the present invention.

What is claimed is:

1. An electrical engagement structure of an Ethernet connector for vehicle, comprising: a plug and a socket; the plug and the socket being combined and engaged together;

the plug comprising a conductive plug shell and a male terminal assembly; the socket combined with a cable to form a cable end socket; the cable end socket comprising a cable end conductive socket shell and a female terminal assembly, the cable end conductive socket shell being mounted around an outer periphery of the female terminal assembly;

the conductive plug shell being mounted around an outer periphery of the male terminal assembly;

he conductive plug shell comprising a lock plate and a lock seat;

the lock plate comprising a hook member, a ramp, and a protrusion; the hook member being disposed on a first end of the lock plate; the ramp and the protrusion being disposed on a top portion of the lock plate;

the lock seat being disposed on a top portion of the conductive plug shell, and internally comprising a rail and a bolt member; the lock plate sliding in the rail; the bolt member being transversely disposed in the lock seat;

the cable end conductive socket shell comprising an outer hook and an elastic plate;

the outer hook being disposed on an outer side of a top portion of the cable end conductive socket shell;

the male terminal assembly comprising a circular male terminal; and the female terminal assembly comprising a circular female terminal;

when the plug is combined with the cable end socket, the conductive plug shell is inserted into the cable end conductive socket shell, with the circular male terminal combined with the circular female terminal; when the lock plate is at a second end of the rail, the ramp resists a second end of the bolt member; when the lock plate is pushed from the second end of the rail toward a first end of the rail, the ramp elastically deforms to cross over the second end of the bolt member, such that the bolt member is engaged between the ramp and the protrusion, and the hook member is engaged with the outer hook of the cable end conductive socket shell;

wherein the cable end conductive socket comprises a cable seal member and a protection member; the cable seal member is mounted around an outer periphery of the female terminal assembly.

2. The electrical engagement structure of claim 1, wherein the plug and the cable end socket comprise a mask, respectively, and each of the masks is integrally formed through a die-casting manner to form a mask providing a whole-masking function, so as to wrap the male terminal assembly or the female terminal assembly; the mask of the cable end socket comprises an elastic plate; the elastic plate is disposed at a first end of the mask of the cable end socket; when the plug is combined with the cable end socket, the elastic plate contacts the mask of the plug.

3. The electrical engagement structure of claim 1, wherein the socket is combined with a PCB to form a board end socket;

the plug is combined and engaged with the board end socket; the board end socket comprises a board end socket shell and a female terminal assembly;

the board end socket shell comprises an outer hook;

the outer hook of the board end socket shell is disposed on an outer side of the top portion of the board end socket shell; and the female terminal assembly comprises a circular female terminal;

when the plug is combined with the board end socket, the plug shell is inserted into the board end socket shell, and the circular male terminal is combined with the circular female terminal; when the lock plate is at the second end of the rail, the ramp resists the second end of the bolt member; when the lock plate is pushed from the second end of the rail toward the first end of the rail, the ramp elastically deforms to cross over the second end of the bolt member, such that the bolt member is engaged between the ramp and the protrusion, and the hook member is engaged with the outer hook of the board end socket shell.

4. The electrical engagement structure of claim 3, wherein the plug and the board end socket comprise a mask, respectively, and each of the masks is integrally formed through a die-casting manner to form a mask providing a whole-masking function, so as to wrap the male terminal assembly or the female terminal assembly; the mask of the board end socket comprises an elastic plate; the elastic plate is disposed at a first end of the mask of the board end socket; when the plug is combined with the board end socket, the elastic plate contacts the mask of the plug.

5. The electrical engagement structure of claim 1, wherein the plug comprises a cable seal member, a plug protection member, and an insertion seal member;

the cable seal member is mounted around an outer periphery of the male terminal assembly; a first end of the cable seal member resists against a second end of the conductive plug shell, with a second end of the cable seal member resisting against a second end of the plug protection member;

the plug protection member wraps the electrical plug shell; and the insertion seal member is disposed on an inner side of an end of the conductive plug shell; when the plug is combined with the cable end socket, the insertion seal member is positioned between the conductive plug shell and the cable end conductive socket shell.

6. The electrical engagement structure of claim 1, wherein [the cable end socket comprises a cable seal member and a protection member; the cable seal member is mounted around an outer periphery of the female terminal assembly;] a first end of the cable seal member resists against a second end of the conductive plug shell, and a second end of the cable seal member resisting against a second end of the protection member; and the protection member wraps the cable end conductive socket shell.

7. The engagement structure of claim 1, wherein the plug and an insertion port of the socket is selectively in a 1×1, 1×2, 1×3, 1×4, 1×5, 2×2, 2×3, or 2×4 mode.

* * * * *